US005173633A

United States Patent [19]

Joo et al.

[11] Patent Number: 5,173,633

[45] Date of Patent: Dec. 22, 1992

[54] DISPENSER CATHODE

[75] Inventors: Kyu-Nam Joo, Seoul; Jong-In Jung; Jong-Suh Choi, both of Kyunggi-do; Hwan-Chul Rho, Seoul, all of Rep. of Korea

[73] Assignee: Samsung Electron Devices Co., Ltd., Kyunggi-Do, Rep. of Korea

[21] Appl. No.: 647,559

[22] Filed: Jan. 29, 1991

[30] Foreign Application Priority Data

Jan. 31, 1990 [KR] Rep. of Korea ..... 1180[U]

[51] Int. Cl.[5] ..... H01J 1/28

[52] U.S. Cl. ..... 313/270; 313/346 DC

[58] Field of Search ..... 313/346 DC, 37, 270

[56] References Cited

U.S. PATENT DOCUMENTS

| | | | |
|---|---|---|---|
| 2,700,000 | 1/1955 | Levi et al. | 313/346 DC |
| 2,972,078 | 2/1961 | Levi | 313/346 DC |
| 4,379,979 | 4/1983 | Thomas et al. | 313/346 R |
| 4,823,044 | 4/1989 | Falce | 313/346 R |
| 4,893,052 | 1/1990 | Tanabe et al. | 313/346 R |

*Primary Examiner*—Palmer C. DeMeo

*Attorney, Agent, or Firm*—Cushman Darby & Cushman

[57] ABSTRACT

A dispenser cathode includes a tungsten matrix which is impregnated with an active cathode material and coated with a refractory thin film layer metal material along the surfaces thereto, but not including the electron emissive surface of the matrix, thereby improving a heat transfer efficiency from a heater to the electron emissive surface.

2 Claims, 2 Drawing Sheets

DISPENSER CATHODE

BACKGROUND OF THE INVENTION

1. Field of the Invention

This invention relates to a dispenser cathode suitable for use in a cathode ray tube and a method of making the dispenser cathode.

2. Description of the Prior Art

As televisions become larger in size and capable of high resolution images, a dispenser cathode in operation with the cathode ray tube of such televisions demands a high performance with continuous electron emission at high current densities without compromising the effective life span of the cathode.

A conventional dispenser cathode as shown in FIG. 1 typically comprises porous tungsten matrix 1 impregnated with barium calcium aluminate ($BaO—CaO—Al_2O_3$). Matrix 1 is contained in reservoir 2 made of refractory metals such as molybdenum and tantalum. The dispenser cathode also includes cylindrical sleeve 3 in which reservoir 2 is fitted at the upper part thereof and heater 4 at the lower part of sleeve 3. The tungsten matrix is formed by compacting a quantity of tungsten powders and sintering the mass at a temperature of 1900°-2300° C. Reservoir 2 having matrix 1 held therein is inserted into sleeve 3 so that it forms flush with its uppermost edges and welded thereto by a conventional laser welding technique. A layer of a platinum-group metal, e.g., Ir, Os, Ru and Re, might be coated on the emissive surface of matrix 1 to improve its electron emissivity.

Although this dispenser cathode is capable of emitting high currency density, it operates at high temperature with low heat transfer efficiency. This is because heat from heater 4 is not effectively transferred to the electron emissive surface of matrix 1 due to reservoir 2 of the dispenser cathode structure which forms a gap between matrix 1 and reservoir 2. Furthermore, the gap may grow in proportion to the difference in the rates of heat expansion associated with the reservoir and matrix.

SUMMARY OF THE INVENTION

An object of the present invention is to provide a dispenser cathode with an improved heat transfer efficiency which does not have a reservoir for supporting a matrix.

A further object of the invention is to provide a method of making the dispenser cathode in large quantities and at less cost.

To achieve these objects, the present invention includes a dispenser cathode having a porous matrix of tungsten which is impregnated with an active cathode material, a sleeve for supporting the matrix, and a heater in the sleeve for heating the cathode to activate an electron emissive material. The impregnated matrix is coated, along the surfaces of the matrix but not along the electron emissive surface of the matrix, with a refractory metal film layer by plasma spraying of refractory metals selected from the group consisting of Mo, Ta and W.

In accordance with the present invention, the method of making a dispenser cathode with an improved heat transfer efficiency comprises the steps of forming a porous tungsten matrix by compacting a quantity of tungsten powders, sintering the compacted matrix and impregnating the sintered matrix with molten active cathode material of barium calcium aluminate ($BaO—Cao—Al_2O_3$) in a reducing atmosphere, and setting the matrix in the sleeve. The improvement lies in the step of coating the impregnated matrix along the surfaces of the matrix but not along the electron emissive surface of the matrix with a refractory metal selected from the group consisting of Mo, Ta and W before setting the matrix in the sleeve.

The diffusion coating of a thin film layer of refractory metal onto the sides and bottom surfaces of the matrix as a substitute for the conventional reservoir enhances the heat transfer efficiency from the heater to the emissive surface of the matrix and prevents a gap from forming between the matrix and the coated thin film layer under high activation temperature.

BRIEF DESCRIPTION OF THE DRAWINGS

The above and other advantages of the invention will become more apparent in the following description and the accompanying drawings in which like numerals refer to like parts and in which.

DETAILED DESCRIPTION OF THE PREFERRED EMBODIMENTS

Figure 1:
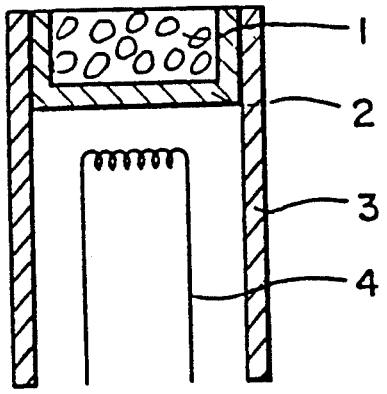
FIG.1 (PRIOR ART)
FIG. 1 shows a conventional dispenser cathode having a reservoir and a porous matrix.
Figure 2:
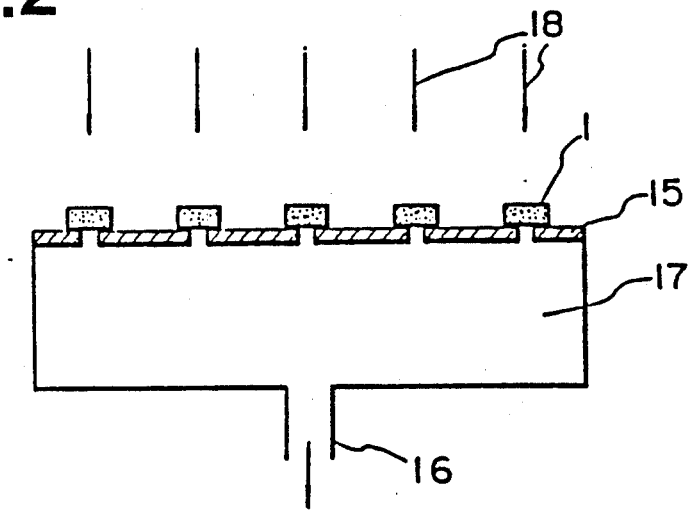
FIG. 2 is a schematic view showing the coating process of a tungsten matrix with refractory metals using a plasma sputtering technique in accordance with the present invention.
Figure 3:
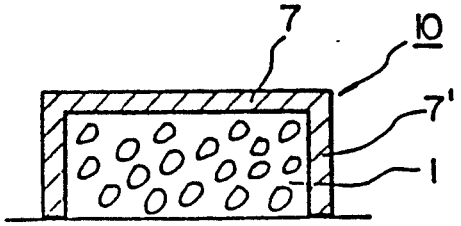
FIG. 3 is a schematic sectional view showing the coated matrix structure of the present invention.

In FIGS. 2 and 3, matrix 1 is typically formed by compacting a quantity of tungsten powders into a shape of pellet and sintering the mass at a temperature of 1900° C. to 2300° C. Matrix 1 is impregnated with an active cathode material, e.g., $BaO—CaO—Al_2O_3$. The vacuum chamber 17 of a conventional depositing apparatus is provided with a plate 15 which consists of a plurality of holes onto which the matrices are coated. The diameter of each hole is less than that of an individual matrix. When the vacuum chamber 17 is evacuated by a pumping means (not shown) through exhaust tube 16 at a pressure of about $10^{-3}$ torr, the matrices placed on the plate at corresponding positions along the holes are adsorbed thereto and held in position. A refractory metal is then sprayed on the surfaces of matrix 1 to provide cathode matrix 10 having thin film layers 7 and 7' coated thereon. The thin film layers serve as a reservoir. Layer 7 has a preferable thickness of about 1μ to 0.01 mm and layer 7' has a preferable thickness of about 0.1μ to 0.05 mm. If layers 7 and 7' are formed too thick heat transfer efficiency is lowered. If layers 7 and 7' are formed too thin cracking is apt to occur. Plate 15 is preferably made of teflon material to endure a high temperature from the sputtered metals, i.e., about 200° C. to 300° C.

Figure 4:
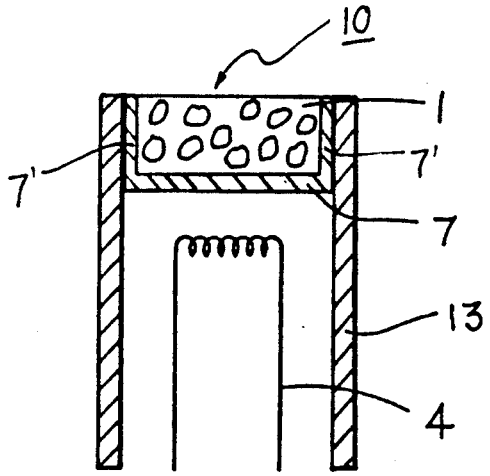
FIGS. 4 and 5 are schematic sectional views of the dispenser cathodes each having the coated matrix of the invention.

FIG. 4 shows a cathode in which matrix 1 coated with refractory metals in accordance with the invention is inserted in sleeve 13 and made flush with the uppermost edges thereof and then set by a laser welding technique.

Figure 5:
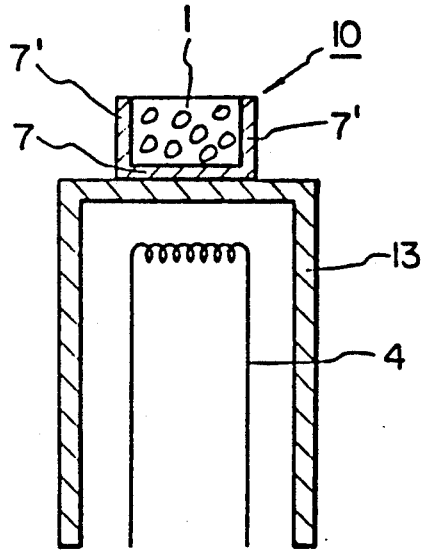

FIG. 5 shows another cathode in which the coated matrix 1 of the invention is set on a top surface of the plate provided at sleeve 13 without any auxiliary heating means. In this type of cathode, the prior art has adopted auxiliary heating wires located between the matrix and the top surface of the plate in the sleeve.

Figure 6:
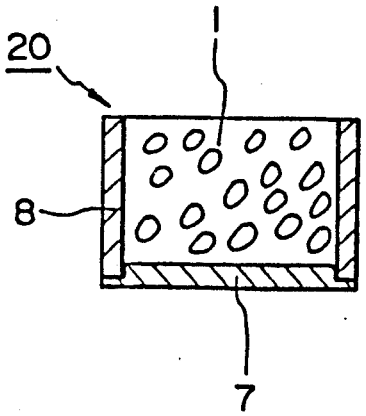
FIG. 6 is a schematic sectional view of the coated matrix inserted in a ring as another embodiment of the invention.

FIG. 6 illustrates another embodiment of the invention in which cathode matrix 20 is different from cathode matrix 10 of FIG. 3 in that the impregnated matrix is first inserted in ring 8 of a refractory metal. The bottom surface of ring 8 which includes the inserted impregnated matrix 1 is then coated with a refractory metal using a coating process as described in FIG. 2.

The cathode having the tungsten matrix coated with a refractory metal in accordance with the present invention has an improved heat transfer efficiency as compared with the prior art cathode in which a matrix is held in a reservoir. As such, heater 4 in the prior art cathode needs a temperature of 1200° C. to heat an electron emissive surface to its activation temperature of 1000° C. However the dispenser cathode of the present invention can be heated to a similar 1000° C. activation temperature of the emissive surface by heating the heater 4 to only 1100° C.

Moreover, the heat transfer efficiency is improved in the cathode of the present invention because no gap is formed between matrix 1 and the coated refractory metal layers 7 and 7', thus contributing to uniform electron emission from the emissive surface of the cathode.

While the invention has been particularly shown and described with reference to preferred embodiments thereof, it will be understood by those skilled in the art that the foregoing and other changes in form and details can be made therein without departing from the spirit and scope of the invention.

We claim:

1. A dispenser cathode comprising:

a porous metal matrix impregnated with an active cathode material and coated, using a plasma spraying method, with a thin film layer of refractory metal material along at least some of the surfaces of the matrix but not along an electron emissive surface of the impregnated matrix, wherein said refractory thin film layer metal material is selected from the group consisting of molybdenum, tantalum and tungsten, and wherein said refractory thin film layer metal material is coated on a side surface of the matrix to a thickness of about $0.1\mu$ to 0.05 mm while the layer opposite the surface of the electron emissive surface of the matrix is coated to a thickness of about $1\mu$ to 0.1 mm;

a sleeve for supporting the impregnated matrix and attachably set thereto by laser welding adjoining sleeve surfaces to the coated matrix surfaces; and a heater contained in a lower cavity of the sleeve.

2. A dispenser cathode comprising:

a porous metal matrix impregnated with an active cathode material and coated, using a plasma spraying method, with a thin film layer of refractory metal material along at least one of the surfaces of the matrix but not along an electron emissive surface of the impregnated matrix, and said impregnated matrix being enveloped along a circular surface by a refractory metal ring, said circular surface being different from said electron emissive surface, wherein a surface of the matrix opposite the electron emissive surface of the matrix is coated with said refractory thin film layer metal material to a thickness of about $1\mu$ to 0.1 mm;

a sleeve for supporting the impregnated matrix and attachably set thereto by laser welding the coated surface opposite the electron emissive surface on a top surface of a plate provided at the sleeve; and a heater contained in a lower cavity of the sleeve.

* * * * *